US005792283A

United States Patent [19]

Roland et al.

[11] Patent Number: 5,792,283

[45] Date of Patent: Aug. 11, 1998

[54] NICKEL-FREE PHOSPHATING PROCESS

[75] Inventors: Wolf-Achim Roland, Solingen; Karl-Heinz Gottwald, Erftstadt; Karl Dieter Brands, Duesseldorf; Jan-Willem Brouwer, Kaarst; Bernd Mayer, Duesseldorf, all of Germany

[73] Assignee: Henkel Kommanditgesellschaft auf Aktien, Duesseldorf, Germany

[21] Appl. No.: 612,925

[22] PCT Filed: Aug. 29, 1994

[86] PCT No.: PCT/EP94/02848

§ 371 Date: Mar. 6, 1996

§ 102(e) Date: Mar. 6, 1996

[87] PCT Pub. No.: WO95/07370

PCT Pub. Date: Mar. 16, 1995

[30] Foreign Application Priority Data

Sep. 6, 1993 [DE] Germany ..... 43 30 104.5
Dec. 2, 1993 [DE] Germany ..... 43 41 041.3

[51] Int. Cl.[6] ..... C23C 22/07
[52] U.S. Cl. ..... 148/260; 148/262
[58] Field of Search ..... 148/262, 260

[56] References Cited

U.S. PATENT DOCUMENTS

| | | | |
|---|---|---|---|
| 4,142,917 | 3/1979 | Yashiro et al. | 148/6.16 |
| 4,708,744 | 11/1987 | Cabado | 106/14.12 |
| 5,207,840 | 5/1993 | Riesop et al. | 148/260 |
| 5,221,370 | 6/1993 | Jo | 148/262 |
| 5,232,523 | 8/1993 | Endo et al. | 148/251 |
| 5,268,041 | 12/1993 | Gehmecker et al. | 148/260 |

FOREIGN PATENT DOCUMENTS

| | | |
|---|---|---|
| 36689 | 9/1981 | European Pat. Off. . |
| 0060716 | 9/1982 | European Pat. Off. . |
| 0228151 | 7/1987 | European Pat. Off. . |
| 0315059 | 5/1989 | European Pat. Off. . |
| 321058 | 6/1989 | European Pat. Off. . |
| 321059 | 6/1989 | European Pat. Off. . |
| 0380067 | 1/1990 | European Pat. Off. . |
| 0459541 | 12/1991 | European Pat. Off. . |
| 544650 | 6/1993 | European Pat. Off. . |
| 2739006 | 4/1978 | Germany . |
| 3920296 | 1/1991 | Germany . |
| 4013483 | 10/1991 | Germany . |
| 4210513 | 10/1993 | Germany . |
| WO8604931 | 8/1986 | WIPO . |
| WO9012901 | 11/1990 | WIPO . |

OTHER PUBLICATIONS

EP -564 -286A2 Oct. 1993.

*Primary Examiner*—David A. Simmons
*Assistant Examiner*—Robert R. Koehler
*Attorney, Agent, or Firm*—Ernest G. Szoke; Wayne C. Jaeschke; Daniel S. Ortiz

[57] ABSTRACT

A process for phosphating surfaces of steel, galvanized or alloy-galvanized steel, aluminum, aluminized or alloy-aluminized steel. The process is particularly useful for treating metal surfaces which are to be cathodic electro-coated. The process uses a nickel, cobalt, copper, nitrite and oxo-anion of halogen free phosphating solution containing 0.3 to 2.0 g/l Zn(II), 0.3 to 4 g/l Mn(II), 5 to 40 g/l phosphate ions and at least one of 0.5 to 5 g/l hydroxylamine and 0.2 to 2 g/l m-nitrobenzene sulfonate wherein the ratio by weight of Zn(II) to Mn(II) is not greater than 2.

24 Claims, No Drawings

NICKEL-FREE PHOSPHATING PROCESS

A nickel-free phosphating process This invention relates to a process for phosphating metal surfaces with aqueous acidic phosphating solutions containing zinc, manganese and phosphate ions and also hydroxylamine in free or complexed form and/or m-nitrobenzenesulfonic acid or water-soluble salts thereof and to their use for pretreating the metal surfaces in preparation for subsequent lacquering, more particularly electrocoating. The process according to the invention may be used for the treatment of surfaces of steel, galvanized or alloy-galvanized steel, aluminium, aluminized or alloy-aluminized steel and, in particular, for the treatment of steel galvanized, preferably electrolytically, on one or both sides.

BACKGROUND OF THE INVENTION

The object of phosphating metals is to produce on the surface of the metals firmly intergrown metal phosphate coatings which, on their own, improve resistance to corrosion and, in combination with lacquers and other organic coatings, contribute towards significantly increasing lacquer adhesion and resistance to creepage on exposure to corrosive influences. Phosphating processes have been known for some time. Low-zinc phosphating processes are particularly suitable for pretreatment before lacquering. The phosphating solutions used in low-zinc phosphating have comparatively low contents of zinc ions, for example of 0.5 to 2 g/l. A key parameter in low-zinc phosphating baths is the ratio by weight of phosphate ions to zinc ions which is normally >8 and may assume values of up to 30.

It has been found that phosphate coatings with distinctly improved corrosion-inhibiting and lacquer adhesion properties can be obtained by using other polyvalent cations in the zinc phosphating baths. For example, low-zinc processes with additions of, for example, 0.5 to 1.5 g/l of manganese ions and, for example, 0.3 to 2.0 g/l of nickel ions are widely used as so-called trication processes for preparing metal surfaces for lacquering, for example for the cathodic electrocoating of car bodies.

RELATED ART

Unfortunately, the high content of nickel ions in the phosphating solutions of trication processes and the high content of nickel and nickel compounds in the phosphate coatings formed give rise to disadvantages insofar as nickel and nickel compounds are classified as critical from the point of view of pollution control and hygiene in the workplace. Accordingly, low-zinc phosphating processes which, without using nickel, lead to phosphate coatings comparable in quality with those obtained by nickel-containing processes have been described to an increasing extent in recent years. The accelerators nitrite and nitrate have also encountered increasing criticism on account of the possible formation of nitrous gases. In addition, it has been found that the phosphating of galvanized steel with nickel-free phosphating baths leads to inadequate protection against corrosion and to inadequate lacquer adhesion if the phosphating baths contain relatively large quantities (>0.5 g/l) of nitrate.

For example, DE-A-39 20 296 describes a nickel-free phosphating process which uses magnesium ions in addition to zinc and manganese ions. In addition to 0.2 to 10 g/l of nitrate ions, the corresponding phosphating baths contain other oxidizing agents acting as accelerators selected from nitrite, chlorate or an organic oxidizing agent.

EP-A-60 716 discloses low-zinc phosphating baths which contain zinc and manganese as essential cations and which may contain nickel as an optional constituent. The necessary accelerator is preferably selected from nitrite, m-nitrobenzenesulfonate or hydrogen peroxide. A dependent claim is directed to the use of 1 to 10 g/l of nitrate; all the Examples mention 4 g/l of nitrate.

EP-A-228 151 also describes phosphating baths containing zinc and manganese as essential cations. The phosphating accelerator is selected from nitrite, nitrate, hydrogen peroxide, m-nitrobenzenesulfonate, m-nitrobenzoate or p-nitrophenol. Dependent claims specify a nitrate content of 5 to around 15 g/l and an optional nickel content of 0.4 to 4 g/l. The corresponding Examples all mention both nickel and nitrate. The main point of this application is that it provides chlorate-free phosphating processes. The same applies to EP-A-544 650.

The phosphating process disclosed in WO 86/04931 is nitrate-free. In this case, the accelerator system is based on a combination of 0.5 to 1 g/l of bromate and 0.2 to 0.5 g/l of m-nitrobenzenesulfonate. Only zinc is mentioned as an essential polyvalent cation, nickel, manganese or cobalt being mentioned as other optional cations. Besides zinc, the phosphating solutions preferably contain at least two of these optional metals. EP-A-36 689 teaches the use of preferably 0.03 to 0.2% by weight of nitrobenzenesulfonate in combination with, preferably, 0.1 to 0.5% by weight of chlorate in phosphating baths of which the manganese content is 5 to 33% by weight of the zinc content.

WO 90/12901 discloses a chlorate- and nittrite-free process for the production of nickel- and manganese-containing zinc phosphate coatings on steel, zinc and/or alloys thereof by spray, spray-dip or dip coating with a solution containing

| | |
|---|---|
| 0.3 to 1.5 | g/l of zinc (II), |
| 0.01 to 2.0 | g/l of manganese (II), |
| 0.01 to 0.8 | g/l of iron (II), |
| 0.3 to 2.0 | g/l of nickel (II), |
| 10.0 to 20.0 | g/l of phosphate ions, |
| 2.0 to 10.0 | g/l of nitrate ions and |
| 0.1 to 2.0 | g/l of an organic oxidizing agent (for example m-nitrobenzenesulfonate), |

the aqueous solution having a free acid content of 0.5 to 1.8 points and a total acid content of 15 to 35 points and $Na^+$ being present in the quantity required to establish the free acid content.

DE-A-40 13 483 describes phosphating processes with which it is possible to obtain anti-corrosion properties comparable with those achieved in trication processes. These processes are nickel-free and, instead, use copper in low concentrations of 0.001 to 0.03 g/l. Oxygen and/or other oxidizing agents with an equivalent effect are used to oxidize the divalent iron formed during the pickling of steel surfaces into the trivalent stage. Nitrite, chlorate, bromate, peroxy compounds and organic nitro compounds, such as nitrobenzenesulfonate, are mentioned as examples of the other oxidizing agents. German patent application P 42 10 513.7 modifies this process to the extent that hydroxylamine, salts or complexes thereof are added in a quantity of 0.5 to 5 g/l of hydroxylamine to modify the morphology of the phosphate crystals formed.

The use of hydroxylamine and/or its compounds to influence the form of phosphate crystals is known from a number of publications. EP-A-315 059, in mentioning one particular effect of using hydroxylamine in phosphating baths, points out that the phosphate crystals are formed in a desirable columnar or nodular form on steel even when the concentration of zinc in the phosphating bath exceeds the range typical of low-zinc processes. It is possible in this way to operate the phosphating baths with zinc concentrations of up to 2 g/l and with ratios by weight of phosphate to zinc of as low as 3.7. Although advantageous cation combinations of these phosphating baths are not discussed in any detail, nickel is used in every Example. Nitrates and nitric acid are also used in the Examples although the specification advises against the presence of nitrate in relatively large quantities.

EP-A-321 059 relates to zinc phosphating baths which, in addition to 0.1 to 2.0 g/l of zinc and an accelerator, contain 0.01 to 20 g/l of tungsten in the form of a soluble tungsten compound, preferably an alkali metal or ammonium tungstate or silicotungstate, an alkaline earth metal silicotungstate or boro- or silicotungstic acid. The accelerator is selected from nitrite, m-nitrobenzenesulfonate or hydrogen peroxide. Nickel in quantities of 0.1 to 4 g/l and nitrate in quantities of 0.1 to 15 g/l are mentioned inter alia as optional constituents.

DE-C-27 39 006 describes a phosphating process for surfaces of zinc or zinc alloys which is free from nitrate and ammonium ions. In addition to an essential content of zinc of 0.1 to 5 g/l, 1 to 10 parts by weight of nickel and/or cobalt per part by weight of zinc are necessary. Hydrogen peroxide is used as the accelerator. From the point of view of hygiene in the workplace and pollution control, cobalt is not an alternative to nickel.

BRIEF DESCRIPTION OF THE INVENTION

The problem addressed by the present invention was to provide phosphating baths which would be free from ecologically and physiologically unsafe nickel and equally unsafe cobalt, would not contain any nitrite and, at the same time, would have a greatly reduced nitrate content and, preferably, would be free from nitrate. In addition, the phosphating baths would be free from copper which is problematical in the effective concentration range of 1 to 30 ppm according to DE-A-40 13 483.

The problem stated above has been solved by a process for phosphating metal surfaces with aqueous acidic phosphating solutions containing zinc, manganese and phosphate ions and, as accelerator, hydroxylamine or a hydroxylamine compound and/or m-nitrobenzenesulfonic acid or water-soluble salts thereof, characterized in that the metal surfaces are contacted with a phosphating solution which is free from nickel, cobalt, copper, nitrite and oxo-anions of halogens and which contains 0.3 to 2 g/l of Zn(II), 0.3 to 4 g/l of Mn(II), 5 to 40 g/l of phosphate ions, 0.1 to 5 g/l of hydroxylamine in free or complexed form and/or 0.2 to 2 g/l of m-nitrobenzenesulfonate and at most 0.5 g/l of nitrate ions, the Mn content amounting to at least 50% of the Zn content.

DETAILED DESCRIPTION OF THE INVENTION

The fact that the phosphating baths are meant to be free from nickel, copper, nitrite and oxo-anions of halogens means that these elements or ions are not intentionally added to the phosphating baths. However, it is not possible in practice to prevent constituents such as these being introduced in traces into the phosphating baths through the material to be treated, the mixing water or through the ambient air. In particular, it is not possible to prevent nickel ions being introduced into phosphating solution in the phosphating of steel coated with zinc/nickel alloys. However, one of the requirements which the phosphating baths according to the invention are expected to satisfy is that, under technical conditions, the concentration of nickel in the baths should be less than 0.01 g/l and, more particularly, less 0.0001 g/l. In a preferred embodiment, no nitrate is added to the baths. However, the baths may well have the nitrate content of the local drinking water (a maximum of 50 mg/l under German legislation on drinking water) or higher nitrate contents caused by evaporation. However, the baths according to the invention should have a maximum nitrate content of 0.5 g/l and preferably contain less than 0.1 g/l of nitrate.

Hydroxylamine may be used in the form of a free base, as a hydroxylamine complex or in the form of hydroxylammonium salts. If free hydroxylamine is added to the phosphating bath or to a phosphating bath concentrate, it will largely be present as hydroxylammonium cation on account of the acidic character of these solutions. Where the hydroxylamine is used in the form of hydroxylammonium salt, the sulfates and phosphates are particularly suitable. Among the phosphates, the acidic salts are preferred by virtue of their better solubility. Hydroxylamine or its compounds are added to the phosphating bath in such quantities that the calculated concentration of free hydroxylamine is between 0.1 and 5 g/l and, more particularly, between 0.4 and 2 g/l. It has proved to be favorable to select the hydroxylamine concentration in such a way that the ratio of the sum of the zinc and manganese concentrations to the hydroxylamine concentration (in g/l) is 1.0 1 to 6.0:1 and preferably 2.0 1 to 4.0:1.

Similarly to the disclosure of EP-A-321 059, the presence of soluble compounds of hexavalent tungsten also affords advantages in regard to corrosion resistance and lacquer adhesion in the phosphating baths according to the invention containing hydroxylamine or hydroxylamine compounds although, in contrast to the teaching of EP-A-321 059, the accelerators nitrite or hydrogen peroxide need not be used in the phosphating process according to the invention. Phosphating solutions additionally containing 20 to 800 mg/l and preferably 50 to 600 mg/l of tungsten in the form of water-soluble tungstates, silicotungstates and/or borotungstates may be used in the phosphating processes according to the invention. The anions mentioned may be used in the form of their acids and/or their ammonium, alkali metal and/or alkaline earth metal salts. m-Nitrobenzenesulfonate may be used in the form of the free acid or in the form of water-soluble salts. "Water-soluble" salts in this context are salts which dissolve in the phosphating baths to such an extent that the necessary concentrations of 0.2 to 2 g/l of m-nitrobenzenesulfonate are reached. The alkali metal salts, preferably the sodium salts, are especially suitable for this purpose. The phosphating baths preferably contain 0.4 to 1 g/l of m-nitrobenzenesulfonate.

A ratio of 1:10 to 10:1 between the more reductive hydroxylamine and the more oxidative m-nitrobenzenesulfonate can lead to particular advantages in regard to layer formation, particularly in regard to the shape of the crystals formed. However, it is also possible and—in the interests of simplified bath control—preferred for the phosphating baths to contain either hydroxylamine or m-nitrobenzenesulfonic acid.

In the case of phosphating baths which are meant to be suitable for various substrates, it has become standard practice to add free and/or complexed fluoride in quantities of up to 2.5 g/l of total fluoride, including up to 800 mg/l of free fluoride. The presence of fluoride in quantities of this order is also of advantage for the phosphating baths according to the invention. In the absence of fluoride, the aluminium content of the bath should not exceed 3 mg/l. In the presence of fluoride, higher Al contents are tolerated as a result of complexing providing the concentration of the non-complexed Al does not exceed 3 mg/l.

The ratio by weight of phosphate ions to zinc ions in the phosphating baths may vary within wide limits providing it remains between 3.7 1 and 30:1. A ratio by weight of 10 1 to 20:1 is particularly preferred. The contents of free acid and total acid are known to the expert as further parameters for controlling phosphating baths. The method used to determine these parameters in the present specification is described in the Examples. Free acid contents of 0.3 to 1.5 points in the phosphating of parts and up to 2.5 points in coil phosphating and total acid contents of around 15 to 25 points are in the usual range and are suitable for the purposes of the present invention.

The manganese content of the phosphating bath should be between 0.3 and 4 g/l because lower manganese contents do not have a positive effect on the corrosion behavior of the phosphate coatings while higher manganese contents have no other positive effect. Contents of 0.3 to 2 g/l are preferred, contents of 0.5 to 1.5 g/l being particularly preferred. According to EP-A-315 059, the zinc content of phosphating baths containing hydroxylamine as sole accelerator is preferably adjusted to values of 0.45 to 1.1 g/l, the zinc content of phosphating baths containing m-nitrobenzenesulfonate as sole accelerator preferably being adjusted to values of 0.6 to 1.4 g/l. However, due to the erosion encountered in the phosphating of zinc-containing surfaces, the actual zinc content of the bath can rise in operation to levels of up to 2 g/l. It is important in this connection to ensure that the manganese content amounts to at least 50% of the zinc content because otherwise inadequate corrosion prevention properties are obtained. In principle, the form in which the zinc and manganese ions are introduced into the phosphating baths is of no consequence. However, to satisfy the conditions according to the invention, the nitrites, nitrates and salts with oxo-anions of halogens of these cations cannot be used. The oxides and/or carbonates are particularly suitable for use as the zinc and/or manganese source. In addition to the divalent cations mentioned, phosphating baths normally contain sodium, potassium and/or ammonium ions which are used to adjust the parameters free acid and total acid. Ammonium ions can also be formed by degradation of the hydroxylamine.

When the phosphating process is applied to steel surfaces, iron passes into solution in the form of iron(II) ions. Since the phosphating baths according to the invention do not contain any substances with a strong oxidizing effect on iron(II), most of the divalent iron changes into the trivalent state as a result of oxidation with air so that it can precipitate as iron(III) phosphate. Accordingly, iron(II) contents distinctly exceeding those present in baths containing oxidizing agents can build up in the phosphating baths according to the invention. Iron(II) concentrations up to 50 ppm are normal in this regard although concentrations of up to 500 ppm can occur briefly during the production process. Iron(II) concentrations of this order are not harmful to the phosphating process according to the invention. In addition, where the phosphating baths are prepared with hard water, they may contain the cations Mg(II) and Ca(II) responsible for hardness in a total concentration of up to 7 mmoles/l.

The process according to the invention is suitable for the phosphating of surfaces of steel, galvanized or alloy-galvanized steel, aluminium, aluminized or alloy-aluminized steel. Hydroxylamine-containing baths are particularly intended for the treatment of steel galvanized, preferably electrolytically, on one or both sides.

The materials mentioned may even be present alongside one another, as is becoming increasingly normal in automobile construction. The process is suitable for dip, spray or spray/dip application. It may be used in particular in automobile construction where treatment times of 1 to 8 minutes are normal. However, it may also be used for coil phosphating in steelworks where the treatment times are between 5 and 12 seconds. As in other known phosphating baths, suitable bath temperatures are between 30° and 70° C., the temperature range from 40° to 60° C. being preferred.

The phosphating process according to the invention is intended for the formation of a low-friction coating for forming operations and, in particular, for the treatment of the metal surfaces mentioned before lacquering, for example before cathodic electrocoating, as is normally applied in automobile construction. The phosphating process may be regarded as one of the steps of the normal pretreatment cycle. In this cycle, phosphating is normally preceded by the steps of cleaning/degreasing, intermediate rinsing and activation, activation normally being carried out with activators containing titanium phosphate. Phosphating in accordance with the invention may be followed by a passivating aftertreatment, optionally after intermediate rinsing. Treatment baths containing chromic acid are widely used for passivating aftertreatments. However, in the interests of pollution control and hygiene in the workplace and also for waste-management reasons, there is a tendency to replace these chromium-containing passivating baths by chromium-free treatment baths. Pure inorganic bath solutions based in particular on zirconium compounds and even organic/reactive bath solutions, for example based on polyvinyl phenols, are known for this purpose. In general, intermediate rinsing with deionized water is carried out between the passivation step and the electrocoating process by which it is normally followed.

EXAMPLES 1 TO 7

Comparison Examples 1 and 2

The phosphating processes according to the invention using hydroxylamine compounds and comparison processes were tested on steel plates (St 1405) and on steel plates electrogalvanized on both sides (ZE), as used in automobile construction. The following sequence of process steps typically applied in body manufacture was carried out (by dip coating or spray coating):

1. For dip coating: cleaning with an alkaline cleaner (Ridoline® C 1250 I, a product of Henkel KGaA), 2% solution in municipal water, 55° C., 4 minutes.

For spray coating: cleaning with an alkaline cleaner (Ridoline® C1206, a product of Henkel KGaA), 0.5% solution in municipal water, 55° C., 2 minutes.

2. Spray or dip rinsing with municipal water, room temperature, 1 minute.
3. Dip activation with an activator containing titanium phosphate (Fixodine® 9112, a product of Henkel KGaA), 0.3% solution in deionized water, room temperature, 1 minute.
4. Phosphating with the phosphating baths according to Table 1. Apart from the cations mentioned in Table 1, the phosphating baths merely contained sodium ions to adjust the free acid content. The baths did not contain any nitrite or any oxo-anions of halogens.

The free acid point count is understood to be the consumption in ml of 0.1 normal sodium hydroxide which is required to titrate 10 ml of bath solution to a pH value of 3.6. Similarly, the total acid point count indicates the consumption in ml to a pH value of 8.2.

5. Spray or dip rinsing with municipal water, room temperature, 1 minute.
6. Spray or dip passivation with a chromate-containing passivating agent (Deoxylyte® 41, a product of Henkel KGaA), 0.14% solution in deionized water, 40° C., 1 minute.
7. Dip or spray rinsing with deionized water.
8. Blow drying with compressed air.

The area-based weight ("coating weight") was determined by dissolution in 5% chromic acid solution in accordance with DIN 50 942, Table 6. Corrosion tests were carried out by the VDA-Wechselklimatest ("alternating climate test") 621-415 with an electrocoating (EP) primer (KTL-hellgrau, a product of BASF, FT 85-7042); and in some cases with a complete multicoat lacquer finish (finishing lacquer: Alpine White, VW). Lacquer creepage (mm) was determined in accordance with DIN 53167 while chipping behavior was determined by the VW test (K-values: best value K=1, worst value K=10), in each case after 10 one-week test cycles. The results are set in Table 2.

TABLE 1

Phosphating baths

| Parameter | Bath No. Ex. 1 | Ex. 2 | Ex. 3 | Ex. 4 | Ex. 5 | Ex. 6 | Ex. 7 | Comp. 1 | Comp. 2 |
|---|---|---|---|---|---|---|---|---|---|
| Zn(II) (g/l) | 1 | 0.9 | 1 | 1 | 1 | 1 | 1 | 1 | 1 |
| Mn(II) (g/l) | 0.8 | 0.5 | 0.8 | 0.8 | 0.8 | 0.8 | 0.8 | 0.8 | 0.5 |
| $PO_4^{3-}$ (g/l) | 14.5 | 12.5 | 14 | 14 | 14 | 14 | 14 | 14.5 | 12.5 |
| W(VI) (ppm) (as Na tungstate) | 0 | 0 | 25 | 50 | 100 | 200 | 500 | 0 | 0 |
| Total $F^-$ (g/l) | 1 | 1 | 0.14 | 0.14 | 0.14 | 0.14 | 0.14 | 1 | 1 |
| Free acid (points) | 1.1 | 1.0 | 0.9 | 0.9 | 0.9 | 0.9 | 0.9 | 1.1 | 1.0 |
| Total acid (points) | 22 | 19.8 | 21.7 | 21.7 | 21.7 | 21.7 | 21.7 | 22 | 19.8 |
| Hydroxyl ammonium sulfate (g/l) | 2 | 1.7 | 2 | 2 | 2 | 2 | 2 | 2 | 1.7 |
| Nitrate (g/l) | — | — | — | — | — | — | — | 2 | 2 |
| Temperature (°C.) | 53 | 51 | 53 | 53 | 53 | 53 | 53 | 53 | 51 |
| Application | Dip | Spray (1 bar) | Spray (1 bar) | Spray (1 bar) | Spray (1 bar) | Spray (1 bar) | Spray (1 bar) | Dip | Spray (1 bar) |
| Time (minutes) | 3 | 1.5 | 1.5 | 1.5 | 1.5 | 1.5 | 1.5 | 3 | 1.5 |

TABLE 2

Coating weights and corrosion results

| Treated in acc. with | Material | Coating weight ($g/m^2$) | EC primer Lacquer creepage (mm) | EC primer Chipping K-value | Full lacquer finish Lacquer creepage (mm) | Full lacquer finish Chipping K-value |
|---|---|---|---|---|---|---|
| Example 1 | ZE | 4.80 | 2.5 | 7–8 | 2.0 | 3–4 |
| Example 2 | ZE | 3.70 | 2.5 | 5–6 | 1.4 | 2 |
| | Steel | 2.70 | 0.6 | 6 | 1.0 | 4 |
| Example 3 | ZE | | 1.9 | 8 | | |
| | Steel | | 1.1 | 6 | | |
| Example 4 | ZE | | 1.6 | 6 | | |
| | Steel | | 0.8 | 5–6 | | |
| Example 5 | ZE | | 1.9 | 5 | | |
| | Steel | | 0.9 | 6–7 | | |
| Example 6 | ZE | | 2.2 | 5 | | |
| | Steel | | 1.2 | 7 | | |
| Example 7 | ZE | | 2.3 | 2 | | |
| | Steel | | 1.2 | 6–7 | | |
| Comparison 1 | ZE | 2.60 | 2.9 | 10 | 3.2 | 8 |
| Comparison 2 | ZE | 3.20 | 2.8 | 8–9 | 2.7 | 8 |
| | Steel | 3.40 | 1.3 | 6–7 | 1.8 | 5–6 |

EXAMPLE 8

Comparison Examples 3 and 4

Process sequence (dip)

1. Cleaning with an alkaline cleaner (Ridoline® C 1250 L, a product of Henkel KGaA), 2% solution in municipal water, 55° C., 4 minutes.
2. Rinsing with municipal water, room temperature, 1 minute.
3. Activation with a liquid activator containing titanium phosphate (Fixodine® L, a product of Henkel KGaA), 1% solution in deionized water, room temperature, 1 minute.
4. Phosphating with the phosphating baths according to Table 3, 53° C., 3 minutes. Apart from the cations mentioned in Table 3, the phosphating baths merely contained sodium ions to adjust the free acid content. The bath of Example 8 did not contain any nitrite or nitrate or any oxo-anions of halogens.
5. Rinsing with municipal water, room temperature, 1 minute.
6. Passivation with a chromium-free passivating agent based on zirconium fluoride (Deoxylyte® 54 NC, a product of Henkel KGaA), 0.25% solution in deionized water, 40° C., 1 minute.
7. Rinsing with deionized water.
8. Blow drying with compressed air.

(Materials and definition of free acid and total acid as for Examples 1 to 7).

Coating weights were determined by dissolution in 5% chromic acid solution. Corrosion tests were carried out by the VDA-Wechselklimatest 621-415 both with EC primer only (ED 12 MB, a product of PPG) and with a complete multicoat lacquer finish (EC as above, filler: one-component high-solid PU filler grey, finishing lacquer: DB 744 metallic basecoat and clearcoat). Lacquer creepage (mm) was evaluated after 10 one-week test cycles. A ball-projection test was also carried out in accordance with the Mercedes-Benz standard based on DIN 53230 (6 bar corresponding to 250 km/h), evaluation at a substrate temperature of −20° C. The area damaged in $mm^2$ (Mercedes-Benz standard: max. 5) and the degree of rust (best value=0, worst value=5, Mercedes-Benz standard: max. 2) were evaluated. The results are set out in Table 4.

TABLE 3

| Parameter | Phosphating baths: Example 8 | Comparison 3 | Comparison 4 |
|---|---|---|---|
| Zn(II) (g/l) | 1.0 | 1.0 | 1.0 |
| Mn(II) (g/l) | 0.8 | 1.0 | 0.8 |
| Ni(II) (g/l) | — | 0.9 | 0.8 |
| $PO_4^{3-}$(g/l) | 14.5 | 14.6 | 13.5 |
| Total $F^-$(g/l) | 0.8 | 0.8 | 0.8 |
| Free acid (points) | 1.0 | 1.0 | 1.0 |
| Total acid (points) | 22 | 23 | 24.0 |
| Hydroxylammonium sulfate (g/l) | 2 | — | 2 |
| Nitrite (mg/l) | — | 100 | — |
| Nitrate (g/l) | — | 2 | 2 |

TABLE 4

Coating weights and corrosion results

| Treated in acc. with | Material | Coating weight ($g/m^2$) | EC Primer: Lacquer creepage (mm) | Full lacquer finish: Lacquer creepage (mm) | Ball projection test: Area damage ($mm^2$) | Ball projection test: Degree of rust |
|---|---|---|---|---|---|---|
| Example 3 | ZE | 3.50 | 1.0 | | 3–4 | 1–2 |
| | Steel | 2.80 | 1.5 | 1.0 | 4 | 1–2 |
| Comparison 3 | ZE | 2.50 | 0.8 | | 4–5 | 0–1 |
| | Steel | 3.0 | 1.0 | 0.5 | 3 | 1–2 |
| Comparison 4 | ZE | 1.90 | <0.5 | | 4 | 1 |
| | Steel | 2.0 | 1.0 | 0.8 | 5 | 0 |

EXAMPLES 9 TO 12

Comparison Examples 5 to 7

The phosphating processes according to the invention using m-nitrobenzenesulfonate and comparison processes were tested on steel plates and on steel plates electrogalvanized on both sides (ZE), as used in automobile construction. The following sequence of process steps typically applied in body manufacture was carried out (by dip coating):

1. Cleaning with an alkaline cleaner (Ridoline® 1558, a product of Henkel KGaA), 2% solution in municipal water, 55° C., 5 minutes.
2. Rinsing with municipal water, room temperature, 1 minute.
3. Dip activation with a liquid activator containing titanium phosphate (Fixodine® L, a product of Henkel KGaA), 0.5% solution in deionized water, room temperature, 1 minute.
4. Phosphating with the phosphating baths according to Table 5 (prepared with deionized water, unless otherwise indicated). Apart from the cations mentioned in Table 1, the phosphating baths merely contained sodium ions to adjust the free acid content. The baths did not contain any nitrite or any oxo-anions of halogens.

The free acid point count is understood to be the consumption in ml of 0.1 normal sodium hydroxide which is required to titrate 10 ml of bath solution to a pH value of 3.6. Similarly, the total acid point count indicates the consumption in ml to a pH value of 8.5.

5. Rinsing with municipal water, room temperature, 1 minute.
6. Passivation with a chromate-containing passivating agent (Deoxylyte® 41, a product of Henkel KGaA), 0.1% solution in deionized water, 40° C., 1 minute.

7. Rinsing with deionized water.

8. Blow drying with compressed air.

The area-based weight ("coating weight") was determined by dissolution in 5% chromic acid solution in accordance with DIN 50 942. Corrosion tests were carried out by the VDA-Wechselklimatest ("alternating climate test") 621-415 with an electrocoating (EP) primer (KTL-hellgrau, a product of BASF, FT 85-7042). Lacquer creepage (mm) was determined in accordance with DIN 53167 while chipping behavior was determined by the VW test VW.P3.17.1 (K-values: best value K=1, worst value K=10). The results are set out in Table 5.

TABLE 5

| | Phosphating baths and test results (use of m-nitrobenzenesulfonate) | | | | | | |
|---|---|---|---|---|---|---|---|
| Parameter | Example 9 | Example 10 | Example 11 | Example 12 | Comp. 5 | Comp. 6 | Comp. 7 |
| Zn(II) (g/l) | 1.0 | 1.0 | 0.9 | 1.0 | 1.0 | 1.0 | 1.0 |
| Mn(II) (g/l) | 0.8 | 0.8 | 0.8 | 0.8 | 0.8 | 0.8 | 0.2 |
| Ni(II) (g/l) | — | — | — | — | 0.7 | — | — |
| $PO_4^{3-}$ (g/l) | 13.7 | 13.7 | 14.5 | 13.7 | 13.7 | 13.7 | 13.7 |
| $SiF_6^{2-}$ (g/l) | 0.95 | 0.95 | 0.95 | 0.95 | 0.95 | 0.95 | 0.95 |
| $F^-$ (g/l) | 0.22 | 0.22 | 0.22 | 0.22 | 0.22 | 0.22 | 0.22 |
| m-Nitrobenzene-sulfonate (g/l) | 0.5 | 0.7 | 1.0 | 0.7 | 0.7 | 0.5 | 0.7 |
| $NO_3^-$ (g/l) | — | — | — | 0.03*) | — | 2 | — |
| Free acid (points) | 1.2 | 1.2 | 1.2 | 1.2 | 1.2 | 1.2 | 1.2 |
| Total acid (points) | 20.0 | 20.0 | 22.0 | 20.0 | 21.0 | 20.0 | 20.0 |
| Electrogalvanized steel plate | | | | | | | |
| Coating weight ($g/m^2$) | 3.7 | 3.5 | 3.3[a)] | 3.0 | 3.9 | 2.6 | 2.5 |
| Lacquer creepage (mm) | 2.5 | 2.3 | 2.1 | 2.9 | 2.3 | 6.0 | 5.0 |
| Chipping value (K) | 7 | 6 | 6 | 7 | 5 | 10 | 9 |
| Steel plate | | | | | | | |
| Coating weight ($g/m^2$) | 2.8 | 2.6 | 2.5 | 2.7 | 2.8 | 2.5 | 2.5 |
| Lacquer creepage (mm) | 1.0 | 0.9 | 1.1 | 0.9 | 0.8 | 1.1 | 1.1 |
| Chipping value (K) | 5 | 6 | 5–6 | 5–6 | 5–6 | 6 | 6 |

*Nitrate content from process water used for preparation

[a)]Aged strip

We claim:

1. A process for phosphating a metal surface which comprises: contacting the metal surface with a phosphating solution which is free from nickel, cobalt, copper, nitrite and oxo-anions of halogens comprising 0.3 to 2 g/l of Zn(II), 0.3 to 4 g/l of Mn(II), 5 to 40 g/l of phosphate ions, at least one member selected from the group consisting of 0.1 to 5 g/l of hydroxylamine in free or complexed form and 0.2 to 2 g/l of m-nitrobenzenesulfonate optionally up to 0.5 g/l of nitrate ions, wherein the Mn(II) content is at least 50% by weight of the Zn(II) content.

2. The process as claimed in claim 1, wherein the phosphating solution contains less than 0.1 g/l of nitrate.

3. The process as claimed in claim 1 wherein the phosphating solution additionally contains fluoride in at least one of free and complexed form in an amount of up to 2.5 g/l of total fluoride, including up to 800 mg/l of free fluoride.

4. The process as claimed in claim 1 wherein the phosphating solution has a ratio by weight of phosphate ions to zinc ions of 3.7:1 to 30:1.

5. The process as claimed in claim 1 wherein the phosphating solution has an Mn(II) content of 0.3 to 2 g/l.

6. The process as claimed in claim 1 wherein the phosphating solution contains m-nitrobenzenesulfonate in the form of the free acid or a water-soluble salt.

7. The process as claimed in claim 1 wherein a total acid content of the phosphating solution is between 15 and 25 points and a free acid content is between 0.3 and 2.5 points.

8. The process as claimed in claim 1 wherein the phosphating solution contains hydroxylamine in at least one form selected from the group consisting of free hydroxylamine complexed hydroxylamine and salts of hydroxylamine.

9. The process as claimed in claim 8, wherein the phosphating solution has a content of hydroxylamine in the at least one form of 0.4 to 2 g/l, expressed as hydroxylamine.

10. The process as claimed in claim 8 wherein the ratio of the sum of the zinc and manganese concentrations in g/l to the hydroxylamine concentration in g/l is 1.0:1 to 6.0:1.

11. The process as claimed in claim 8 wherein the phosphating solution additionally contains 20 to 800 mg/l of a water-soluble tungsten compound.

12. The process as claimed in claim 1 wherein the phosphating solution contains one of hydroxylamine or m-nitrobenzenesulfonic acid.

13. The process as claimed in claim 1 wherein the surface-treated comprises at least one member selected from the group consisting of steel, galvanized steel, alloy-galvanized steel, aluminium, aluminized steel and alloy-aluminized steel.

14. The process as claimed in claim 13, wherein the metal surface is contacted with the phosphating solution by a method selected from the group consisting of spraying, dipping or spraying/dipping for a contact time of 5 seconds to 8 minutes.

15. The process as claimed in claim 14, wherein the temperature of the phosphating solution is between 30° C. and 70° C.

16. The process as claimed in claim 15 further comprising lacquering the phosphated surface.

17. The process of claim 4 wherein the ratio by weight of phosphate ions to zinc ions is from 10:1 to 20:1.

18. The process of claim 5 wherein the Mn(II) content of the phosphating solution is from 0.5 to 1.5 g/l.

19. The process of claim 6 wherein the phosphating solution contains from 0.4 g/l to 1.0 g/l of m-nitrobenzenesulfonate.

20. The process of claim 7 for treating parts wherein the free acid content of the phosphating solution is from 0.3 to 1.5 points.

21. The process of claim 7 for coil phosphating wherein the free acid content of the phosphating solution is from 0.3 to 2.5 points.

22. The process of claim 10 wherein the ratio of the sum of the zinc and manganese concentration in g/l to the hydroxylamine concentration in g/l is from 2.0:1 to 4.0:1.

23. The process of claim 11 wherein the water soluble tungsten compound comprises at least one member selected from the group consisting of tungstates, silicotungstates and borotungstates in the form of an acid, ammonium salt, alkali metal salt or alkaline earth metal salt.

24. The process of claim 16 wherein the metal surface is cathodic electrocoated.

* * * * *